United States Patent [19]

Driskill

[11] Patent Number: 4,548,437

[45] Date of Patent: Oct. 22, 1985

[54] DOWNHOLE WELL FISHING ASSEMBLY

[75] Inventor: Darrel Driskill, Ardmore, Okla.

[73] Assignee: Larson Supply Company, Oklahoma City, Okla.

[21] Appl. No.: 620,625

[22] Filed: Jun. 14, 1984

Related U.S. Application Data

[63] Continuation-in-part of Ser. No. 461,440, Apr. 15, 1983, abandoned.

[51] Int. Cl.[4] ..... E21B 31/02

[52] U.S. Cl. ..... 294/86.3; 294/86.18; 294/86.33

[58] Field of Search ..... 294/86.3, 86.25, 86.1, 294/86.17, 86.18, 86.19, 86.2, 86.26, 86.29, 86.31, 86.33, 86.14, 906, 96; 166/88, 89, 99; 175/315

[56] References Cited

U.S. PATENT DOCUMENTS

| | | | |
|---|---|---|---|
| 1,671,979 | 6/1928 | Cook | 24/201 R |
| 1,687,808 | 10/1928 | Thomas et al. | 294/86.3 |
| 1,745,274 | 1/1930 | Sauls | 294/86.33 |
| 1,754,696 | 4/1930 | Sauls | 294/86.33 |
| 1,776,024 | 9/1930 | Hinderliter | 294/86.3 |
| 1,797,505 | 3/1931 | Jones et al. | 294/86.33 |
| 1,825,025 | 9/1931 | Thomas et al. | 294/86.3 |
| 1,970,624 | 8/1934 | Recker | 248/2 |
| 2,075,241 | 3/1977 | Thompson | 294/86.17 |
| 2,213,919 | 9/1940 | Michon | 164/118 |
| 2,272,529 | 2/1952 | Larson | 294/86.33 |
| 3,368,834 | 2/1968 | Stratienko | 287/52.09 |
| 3,618,177 | 8/1970 | Wood | 24/201 R |
| 3,851,987 | 12/1974 | Jones | 294/86.33 |
| 3,920,342 | 11/1975 | Warda | 403/352 |
| 3,950,021 | 4/1976 | Goldschild et al. | 294/86.28 |
| 4,185,865 | 1/1980 | Taylor | 294/86.3 |

*Primary Examiner*—James B. Marbert

*Attorney, Agent, or Firm*—Dunlap, Codding & Peterson

[57] ABSTRACT

A fishing tool comprising a body member having an offset entrance port into a cylindrical cavity that contains a slide member having a trough-shaped lower portion positionable adjacent the entrance port in either of two diametrically opposed angular positions to alternatively capture or release an enlargement on a rod inserted into the body member cavity via the entrance port. Grooves are cut into the slide member and a pin is mounted on the body member to rotate the slide member one half turn when the slide member is reciprocated in the cavity. The rod can be a portion of a collet in a barrel attached to the body member, the bore of the barrel and the collet having mating frustoconical surfaces for collapsing the collet fingers about a uniform diameter rod when the rod portion of the collet is released from the body member and slide member.

16 Claims, 14 Drawing Figures

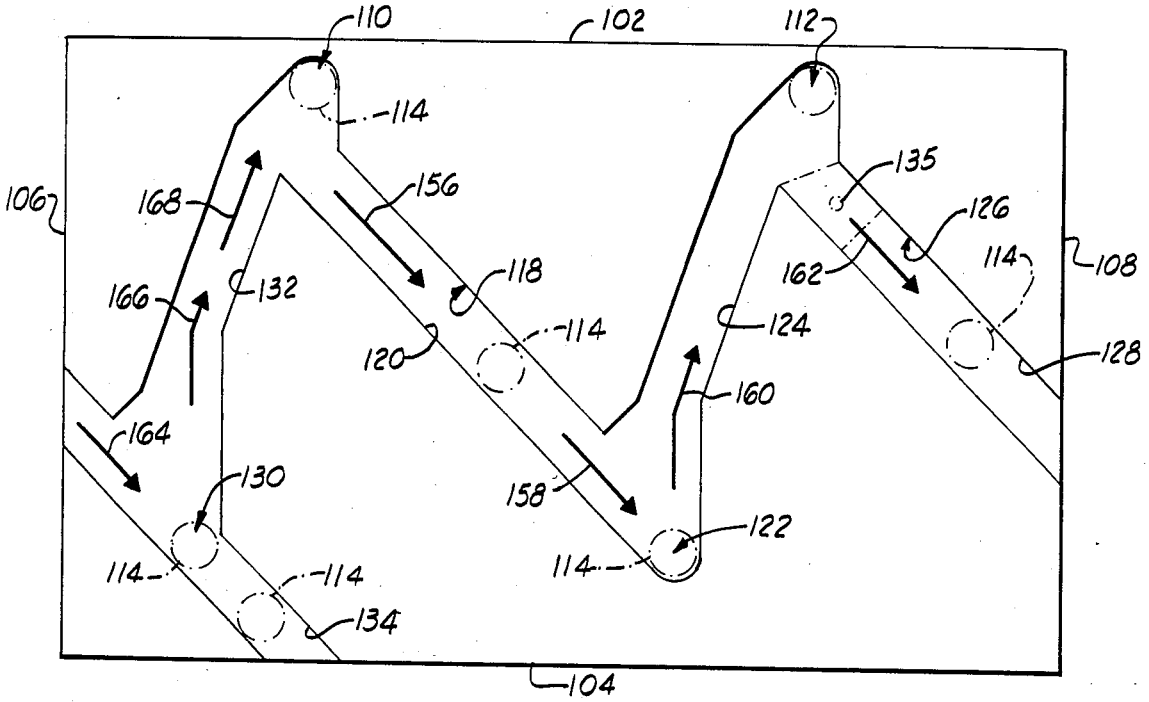
FIG. 7
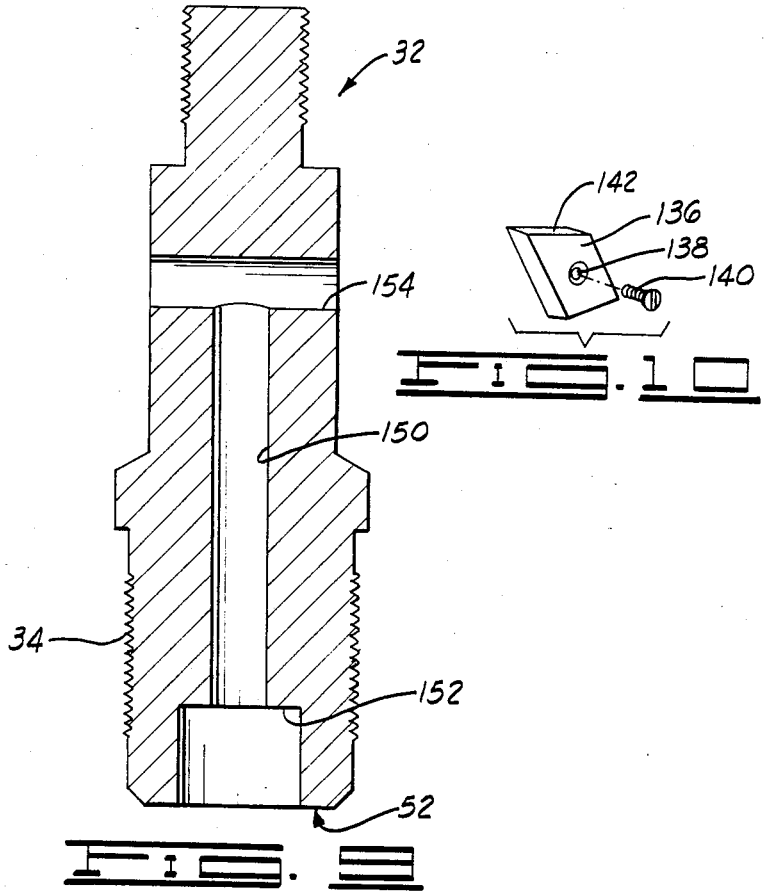
FIG. 10
FIG. 8

DOWNHOLE WELL FISHING ASSEMBLY

CROSS REFERENCE TO RELATED APPLICATION

This application is a continuation-in-part application of copending patent application Ser. No. 461,440, entitled "Automated Double Catch Sucker Rod Fishing Tool", filed April 15, 1983, now abandoned.

BACKGROUND OF THE INVENTION

1. Field of the Invention.

The present invention relates to the oil field service industry, and more particularly but not by way of limitaion, to downhole equipment and the recovery of same.

2. Discussion of Prior Art.

The patent issued to Larson, U.S. Pat. No. 2,272,529, on February 10, 1942 taught a fishing tool for the recovery of separated sucker rods. Larson's fishing tool used a barrel body which had an eccentric sleeve that was positionable via selective rotation of the barrel to grip the downhole sucker rod portion that has separated. Once gripped, the fishing tool was brought to the surface, pulling the separated sucker rod with it.

The patent issued to Taylor, U.S. Pat. No. 4,185,865, on January 29, 1978, taught a fishing tool, also sometimes referred to as an overshot, which was operable on a wireline. A retractable set of collet fingers mounted in an overshot body is engageable with a fish (a downhole member that is to be retrieved), and repeated bumping against the fish extending into the collet fingers results in the opening or closing of the collet fingers via cam actuated internal rotation of the collet fingers, and the fish pulls the collet fingers into gripping engagement as it pulls the closed collet fingers through the tapered opening of the overshot body.

While the Larson and Taylor patents taught improvements in an area occupied with numerous prior art fishing devices, certain deficiencies remain, notably the ability to exercise positive control at the surface over subsurface, downhole fishing assemblies.

SUMMARY OF THE INVENTION

The present invention provides an improved fishing assembly for use in retrieving a rod-like downhole member, such as a separated or broken sucker rod, from a well. To this end, the fishing assembly has a hollow body member in which a slide member is disposed for both rotation and reciprocation within the body member. A camming system, connected between the body member and the slide member couples rotation of the slide member to reciprocation of the slide member so that the slide member will undergo a half turn of revolution for each reciprocation of the slide member starting from a lower position of the slide member adjacent the lower end of the body member. An entrance port is formed at the lower end of the body member so that a rod can be inserted into the body member and the entrance port and portions of the slide member are shaped so that a joint on one end of a sucker rod can be inserted into the body member or removed therefrom for one of two angular positions of the slide member when the slide member is disposed in the lower axial position forming one limit of the reciprocation of the slide member but will be captured when the slide member is at the other of the two angular positions the slide member assumes when in the lower axial position thereof.

In a second embodiment of the invention, the fishing assembly also includes a tubular collet support barrel extending from the lower end of the body member to receive a collet having a shank including an enlarged upper end so that the collet can be held in a raised position in one of the two angular positions of the slide member and the body member or can be released to fall to the bottom of the collet support barrel in the other of the two angular positions of the slide member and the body member. That is, in the second embodiment, the collet shank can be captured or released in the same manner that a joint on a sucker rod can be captured or released by the body member and slide member. A frustoconical surface is formed at the end of the collet support barrel and the collet is comprised of a plurality of depending fingers upon which a mating frustoconical surface is formed so that a straight rod can be gripped by the collet by placing such rod in the collet and drawing the collet into the lower end of the collet support barrel. Conversely, the straight rod can be released by forcing the collet upwardly into the body member to reciprocate the slide member and thereby cause the slide member to move to an angular position in which the upper end of the shank of the collet will be captured within lower portions of the body member.

It is an object of the present invention to provide an improved fishing assembly that can alternatively connect to or release a downhole member located in a well.

Another object of the present invention is to provide an improved fishing assembly which is easily operable to grasp or release a rod located in a well.

A further object of the invention is to provide a fishing assembly which is inexpensive to fabricate and maintain.

Other objects, advantages and features of the present invention will become apparent from the following detailed description when read in conjunction with the drawings and appended claims.

BRIEF DESCRIPTION OF THE DRAWINGS

FIG. 7 illustrates the surface of the upper portion of the slide member to show the sockets and grooves formed therein as part of the camming system which relates the angular position of the slide member to the axial position thereof within a cylindrical cavity formed in the fishing assembly body member.

FIG. 9 is a cross section in side elevation of the end cap of the fishing assembly body member.

FIG. 10 is an isometric view of a detachable stop that can be attached to the slide member within one of the grooves of the camming system.

DESCRIPTION OF FIGS. 1—10

Figure 1:
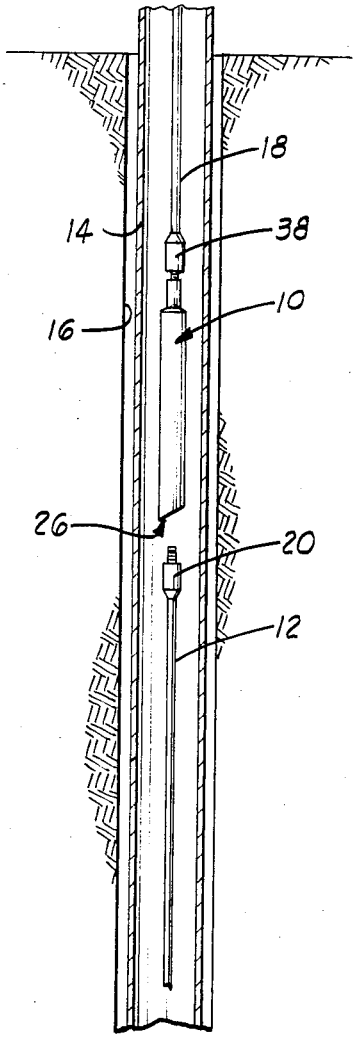
FIG. 1 is a cutaway, schematic representation of an oilwell containing a separated sucker rod and depicting the fishing assembly of the present invention being lowered to retrieve the sucker rod.

Referring now to FIGS. 1-10 in general and to FIG. 1 in particular, shown therein and designated by the general reference numeral 10 is one preferred embodiment of a fishing assembly constructed in accordance with the present invention. The fishing assembly 10 is used to provide a connection to a downhole member or "fish" 12, such as a sucker rod, disposed in a casing 14 of a well borehole 16 so that fish can be retrieved from the well. In use, the fishing assembly 10 is lowered into the well via a supporting member, which can be a rod or wireline, so that, once the connection to the fish has been made, the fish can be drawn upwardly from the well.

For purposes of illustration, FIG. 1 has been drawn for the case in which the supporting member is a rod 18 and the "fish" 12 is a sucker rod that has become separated from sucker rods which would normally connect the sucker rod shown to the polish rod of a pumping unit disposed on the earth's surface. In such case, the sucker rod 12 terminates at its upper end in an enlarged portion 20 forming half of a joint by means of which successive sucker rods in a string are connected together to provide a connection between the pumping unit polish rod and a downhole pump. However, it should be noted that the fishing assembly 10 is not limited to such application; as will be discussed below, the fishing assembly 10 can also be utilized to make a connection to a sucker rod string when a sucker rod has broken so that small diameter portions of the broken sucker rod remain attached to the enlarged portion 20 and extend upwardly therefrom.

Figure 2:
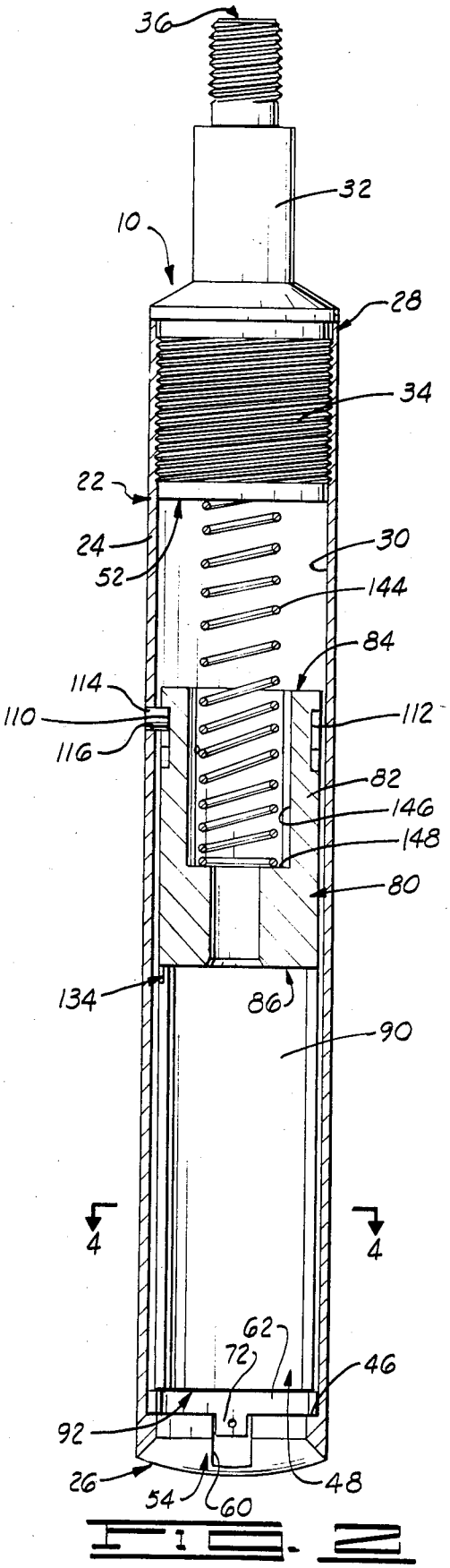
FIG. 2 is a cross section in side elevation of the fishing assembly shown in FIG. 1.

As shown in FIG. 2, the fishing assembly 10 is comprised of a body member 22 that is preferably formed in two parts to facilitate machining of the body member 22 and to enable the fishing assembly to be adjusted to fit the job at hand. In particular, the body member 22 is comprised of a substantially tubular sleeve 24 having a lower end 26, that forms a lower end of the body member 22, and an upper end 28. Portions of the bore 30 of the sleeve 24 adjacent the upper end 28 are threaded and the body member 22 further comprises an end cap 32 having a threaded lower portion 34 so that the body member 22 can be assembled by screwing the end cap 32 into the upper end of the sleeve 24.

The end cap 32 has an upper end 36, forming an upper end of the body member 22, and portions of the end cap 32 adjacent the upper end 36 thereof are externally threaded so that the body member 22 can be screwed into a joint 38 (FIG. 1) on the lower end of the rod 18 for lowering the fishing assembly into the casing 14. In the case in which the fishing assembly 10 is lowered into the casing 14 via a wireline, a female screw connector (not shown), equivalent to the joint 38, is attached to one end of the wireline so that the end cap 32 can be screwed into such connector for lowering the fishing assembly 10 into the casing 14.

Figure 3:
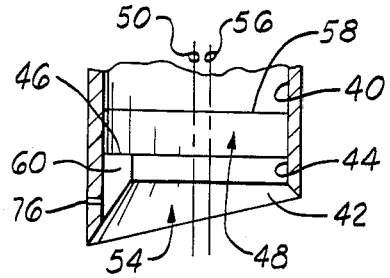
FIG. 3 is a cross section of the lower end of a tubular sleeve forming a portion of the fishing assembly body member and rotated 90° with respect to the cross section shown in FIG. 2.
Figure 4:
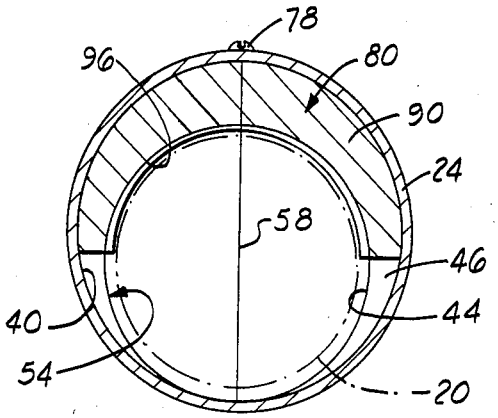
FIG. 4 is a cross section of the fishing assembly shown in FIG. 2 taken along line 4—4 and illustrating one of the two angular positions the slide member assumes when the slide member is in the lower axial position thereof.
Figure 5:
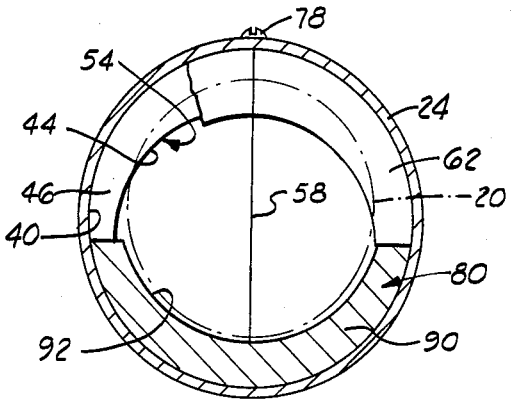
FIG. 5 is a cross section similar to FIG. 4 but illustrating the second angular position of the slide member when the slide member is in the lower axial position thereof.

As is particularly shown in FIGS. 3-5, the bore 30 is divided into three serially disposed portions: a cylindrical upper portion 40 that intersects the upper end 28 of the sleeve 24 and extends therefrom toward the lower end 26 of the body member 22; a frusto conical lower portion 42 that intersects the lower end 26 of the body member 22 and extends toward the upper end 36 of the body member 22; and a central portion 44 that extends between the upper and lower portions 40 and 42. The central portion 44 of the bore 30 has a diameter that is smaller than the diameter of the upper portion 40 so that an internal shoulder 46 is formed in portions of the bore 30 adjacent the lower end 26 of the body member 22. The shoulder 46 forms the lower end of a cylindrical cavity 48 that extends axially through central portions of the body member 22 about an axis 50 disposed generally along a longitudinal centerline of the body member 22, the upper end of the cavity 48 being formed by the lower end 52 of the end cap 32 and the wall of the cavity being formed by portions of the upper portion 40 of the bore 30.

The lower and central portions, 42 and 44 respectively, of the bore 30 form an entrance port 54 into the cavity 48, the entrance port 54 being offset to one side of the lower end of the cavity 48 by forming the lower and central portions, 42 and 44 respectively, of the bore 30 about an axis 56 that parallels the axis 50 and is spaced a distance from the axis 50 along a diameter 58 of the cavity 48. Preferably, the axes 50 and 56 are spaced a distance equal to the difference in radii of the upper and central portions, 40-44 respectively, of the bore 30 so that the shoulder 46 has a relatively large radial thickness at one end of the diameter 58 and narrows to substantially zero thickness at the other end of the diameter 58 as can be seen by comparing FIGS. 4 and 5.

It will thus be seen that the enlarged portion 20 of the rod 12 can be introduced into the cavity 48 by bringing the fishing tool 10 down upon the upper end of the rod 12 to permit the enlarged portion 20 to enter the cavity 48 via the entrance port 54. The entry of the enlarged portion 20 of the rod 12 into the cavity 48 is facilitated by the frusto conical shape of the lower portion 42 of the bore 30 which results in the bore 30 flaring at the lower end 26 of the body member 22 as can be seen in FIG. 3.

Figure 6:
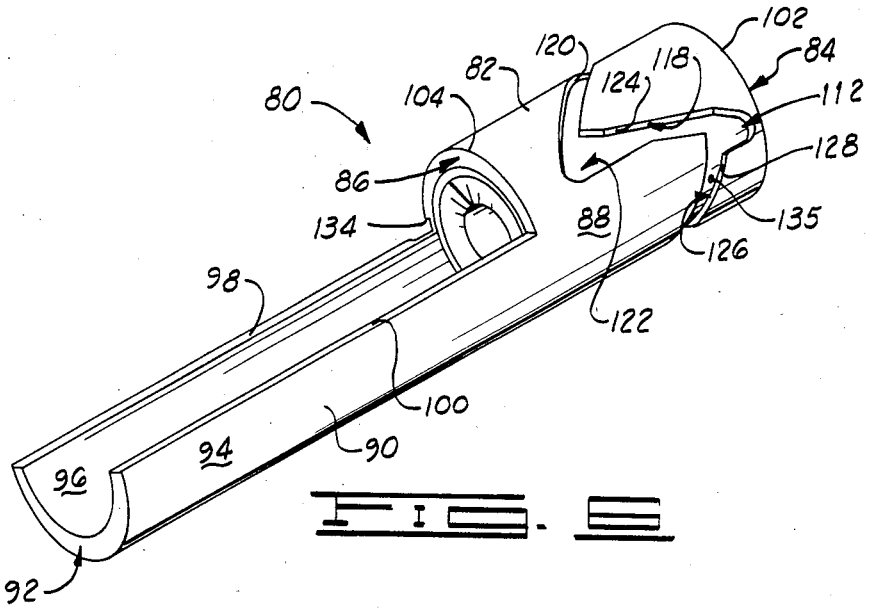
FIG. 6 is an isometric view of the slide member of the fishing assembly.
Figure 8:
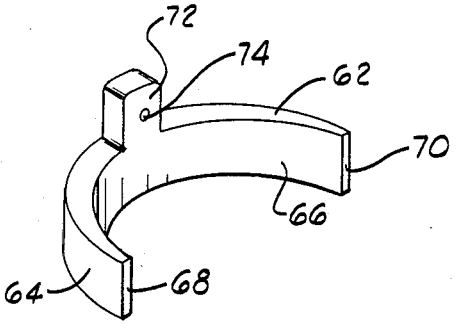
FIG. 8 is an isometric view of an entrance port restriction member that can be used with the fishing assembly shown in FIG. 2.

In the preferred constuction of the fishing assembly 10, a groove 60 is formed through radially wider portions of the shoulder 46, the groove 60 extending parallel to the axes 50 and 56, to facilitate mounting of an entrance port restriction member 62 within the cavity 48 adjacent the lower end thereof as shown in FIG. 2. The restriction member 62, which has been further illustrated in FIG. 8, has the general form of a semi-cylindrical arc having an outer, semi-cylindrical surface 64 that mates with the wall of the cavity 48 and an inner, semi-cylindrical surface 66 that is formed on a diameter smaller than the diameter of the surface 64 and centered on an axis that is offset from the axis of the surface 64 so that central portions of the restriction member 62 are wider than portions of the member 62 near the ends 68 and 70 thereof. A tab 72, having a threaded hole 74 formed therethrough to extend radially of the surfaces 64 and 66, extends from one side of central, thicker portions of the restriction member 62 to fit within the groove 60 and a hole 76 is formed through the sleeve 24, to intersect the groove 60, so that the restriction member 62 can be secured within the cavity 48 via a screw 78 (FIGS. 4 and 5) that passes through the hole 76 and is screwed into the hole 74. The radius of curvature of the inner surface 66 of the member 62 is selected so that the member 62 will overlay portions of the entrance port 54 as shown in FIG. 5 and, because of the positioning of the groove 60 in the sleeve 24 and the positioning of the tab 72 on the restriction member 62, such portions of the entrance port 56 will be those portions nearest the axis 50 of the cavity 48. Thus, the restriction member 62 can be utilized to, in effect, vary the size of the entrance port 54 and such variation in the size of the entrance port 54 is utilized to adapt the fishing assembly 10 to rods having different diameter joints forming the enlarged portion 20. That is, the entrance port 54 is sized to accept a joint on any sucker rod that might be encountered in the field and one of a series of restriction members 62 for which the surfaces 66 have different radii of curvature is used to neck down the entrance port to fit the enlarged portion 20 of the sucker rod tht is to be retrieved in any particular job. The fishing assembly 10 can also be used without a restriction member 62 when the diameter of the enlargement 20 is not greatly smaller than the diameter at the entrance port 54. Referring now to FIGS. 2 and 6, the fishing assembly 10 further comprises a slide member 80 which is disposed within the cavity 48 to extend axially along the cavity axis 50. The slide member 80 is comprised of a slide member upper portion 82 having an upper end 84, forming an upper end of the slide member 80 and facing the upper end 36 of the body member 22, a lower end 86 that faces the lower end 26 of the body member 22, and a circular outer periphery 88 extending between the upper and lower ends 84 and 86 of the slide member upper portion 82 and having a diameter substantially equal to the diameter of the cavity 48. Extending from one side of the lower end 86 of the slide member upper portion 82, the slide member further comprises a slide member lower portion 90 which extends to a lower end 92 of the slide member 80. Preferably, the slide member lower portion 90 has the form of a semicylindrical trough having a curved outer surface 94 that forms an axial extension of portions of the periphery 88 of the upper slide portion 82 and a curved inner surface 96 having a radius of curvature substantially equal to the radius of the central portion 44 of the bore 30 and centered on an axis displaced from the center of curvature of the outer surface 94 in substantially the same manner that the axis 56 of the central portion 44 of the bore 30 is displaced from the cavity axis 50. Connecting the inner and outer surfaces 94 and 96 are two flats 98 and 100 which extend the length of the slide member lower portion 90.

The length of the slide member 80 is made less than the length of the cavity 48 so that the slide member 80 can be moved axially within the cavity 48. More particularly, the slide member 80 can be reciprocated along the cavity axis 50 from a lower position, shown in FIG. 2 and in which the slide member 80 is positioned adjacent the entrance port 54 into the cavity 48, to a raised position in which the slide member 80 is disposed adjacent the lower end 52 of the end cap 32. Similarly, because of the curved shapes of the outer periphery 88 and outer surface 94 of the two portions of the slide member 80, the slide member 80 can rotate within the cavity 48 about the cavity axis 50.

In the practice of the present invention, rotation of the slide member 80 about the cavity axis 50 is coupled to axial movement of the slide member 80 along the cavity axis by a camming system (not numerically designated in the drawings) that is formed partially on the body member 22 and partially on the slide member 80. The portion of the camming assembly that is formed on the slide member 80 is comprised of a system of sockets and grooves cut into the outer peripheral surface 88 of the slide member upper portion 82 and FIG. 7 has been included to illustrate such system of sockets and grooves. In particular, FIG. 7 illustrates the surface 88 mapped onto a plane so that the horizontal edges 102 and 104 in FIG. 7 are upper and lower circumferential edges, respectively, of the ends of the slide member upper portion 80, such edges having been designated by the same numerals in FIG. 6. The lateral edges 106 and 108 in FIG. 7 both correspond to a single line extending along the peripheral surface 88 of the slide member upper portion 82 between the edges 102 and 104 parallel to the cylinder axis of the slide member upper portion 82. (In particular, the edges 106 and 108 extend generally along the lower edge of the depiction of the slide member 80 in FIG. 6. However, the edges 106 and 108 in FIG. 7 can be any line extending axially along the peripheral surface 88 so that, subject to a criterion to be discussed below, the socket and groove system shown in FIG. 7 and partially shown in FIG. 6 can be arbitrarily positioned on the slide member upper portion 82.)

Near the upper end 84 of the slide member 80; that is, near the edge 102, two diametrically opposed upper sockets 110 and 112 are cut into the peripheral surface 88 and these sockets receive a pin 114 (FIG. 2) that is mounted in a hole 116 bored radially through the sleeve 24 to comprise the portion of the camming assembly that is formed on the body member 22. This pin has also been indicated in phantom line, for a number of positions of the slide member 80 within the body member 22, in FIG. 7 for purposes of discussing the operation of the fishing assembly 10 below. A V-shaped groove 118 is formed in the peripheral surface 88 between the two upper sockets 110, 112 and the groove 118 has a first leg 120 that extends downwardly from the upper socket 110 to a lower socket 122 at the apex of the V-shaped groove 118. A second leg 124 of the groove 118 then extends upwardly from the lower socket 122 to the upper socket 112. In the preferred construction of the camming assembly, a second V-shaped groove 126, identical to the groove 118, is formed between the upper sockets 110 and 112, the second groove 126 similarly having a first leg 128 that extends downwardly from the upper socket 112 to a lower socket 130 near the lower end of the slide member upper portion 82 and a second leg 132 that extends upwardly from the lower socket 130 to the upper socket 110. A groove 134 is cut into the peripheral surface 88 between the lower socket 130 and the lower edge 104 of the slide member upper portion 82 to facilitate assembly of the fishing assembly 10 as will be discussed below.

In addition to preferentially including two grooves 118 and 126 in the peripheral surface 88, it is also preferred to angularly offset the sockets 110, 112, 122 and 130 with respect to the two V-shaped grooves 118 and 126. In particular, and as shown in FIG. 7, the socket 112 is not positioned directly above the intersection of the second leg 124 of the groove 118 and the first leg 128 of the groove 126; rather, the socket 110 is angularly shifted with respect to such intersection to be axially aligned with portions of the first leg 128 of the groove 126. Similarly, the socket 110 is axially aligned with portions of the first leg 120 of the groove 118; the socket 122 is axially aligned with portions of the second leg 124 of the groove 118; and the socket 130 is axially aligned with portions of the second leg 132 of the groove 126. The purpose of this offset between the sockets and the grooves formed in the peripheral surface 88 of the slide member upper portion 82 will be discussed below. Where two grooves are used to connect two upper sockets 110 and 112, it is also preferred to form a threaded, radially extending hole 135 into the slide member upper portion 82, such hole being positioned within the first leg 128 of the groove 126 at the opening of the groove 126 into the socket 112. (As will be discussed below, the formation of the hole 134 in the first leg of the groove 126 rather than the first leg of the groove 118 depends upon the manner in which the above mentioned criterion for positioning the grooves on the slide member 80 is met.) The hole 135 permits a detachable stop 136, illustrated in FIG. 10 and shown in phantom line in FIG. 7, to be mounted in the groove 126 at the opening of such groove into the socket 112. To this end, a hole 138 is formed through the stop 136 so that the stop can be placed in the groove 126 and a screw 140 can be passed through the hole 138 and screwed into the hole 135 to secure the stop 136 to the slide member 82. The stop 136 has an upper surface 142 that is angled with respect to the longitudinal axis of the stop 136 so that, when the stop 136 is mounted in the groove 126 with the upper surface 142 thereof facing the upper socket 112, the upper surface 142 slopes toward the second leg 124 of the groove 118.

Coming now to the criteria for positioning the grooves on the slide member 80, it will first be noticed that upper and lower axial positions can be defined for the slide member 80 via the positioning of the sockets 110, 112, 122 and 130 on the slide member 80 and the positioning of pin 114 on the sleeve 24. In particular, the lower axial position of the slide member 80 is defined by the condition that the pin 114 be in one of the upper sockets 110 and 112, the length of the slide member lower portion 90 and the distance between the upper sockets and the lower end of the slide member upper portion 82 being selected with respect to the distance between the pin 114 and shoulder 46 so that the lower end 92 of the slide member 80 will be positioned a short distance above the shoulder 46 when the pin 114 is in either of the sockets 110 or 112. (A separation is left between the shoulder 46 and the lower end 92 of the slide member 80 for the lower axial position of the slide member 80 to permit an entrance port restriction member 62 to be placed in the cavity 48 if desired.) Similarly, the distance between the upper sockets and the upper end 84 of the slide member 80 and the distance between the pin 114 and end cap 32 are selected so that the upper end 84 of the slide member 80 will be positioned adjacent the lower end 52 of the end cap 32, to define the upper axial position for the slide member 80, when the pin 114 is disposed in either of the lower sockets 122 or 130.

It will further be noticed that the slide member 80 can be in either of two angular positions at such times that the slide member 80 is in the lower axial position thereof, one angular position occuring when the pin 114 is in the upper socket 110 and the other angular position occuring when the pin 114 is in the upper socket 112. Moreover, since the sockets 110 and 112 are positioned in diametric opposition in the slide member upper portion 82, the two angular positions corresponding to the lower axial position are 180° apart. Such spacing is utilized to provide the fishing assembly with a capture assembly (not numerically designated in the drawings) that can be utilized to alternatively capture or release the enlargement 20 on the downhole member 14 so that the fishing assembly 10 can provide a connection to the downhole member 14 or release the downhole member 14.

The capture assembly is comprised of the slide member lower portion 90 and the shoulder 46 that is formed about the entrance port 54 by the offsetting of the lower and central portions, 42 and 44 respectively of the sleeve bore 30 along the axis 58 of the upper portion 40 of the bore 30. Additionally, the capture assembly is comprised of the entrance port restriction member 62 where such member is mounted within the cavity 48 of the body member 22. In the practice of the invention, the two angular positions of the slide member lower portion 90 are used to define a release position, shown in FIG. 4, and a capture position, shown in FIG. 5. In the release position, the slide member lower portion 90 is centered on one end of the diameter 58 along which the axis of the entrance port 54 is offset from the axis of the cavity 48 so that the slide member lower portion 90 will overlay the widest portions of the shoulder 46 and the entrance port restriction member 62 at such times that a restriction member 62 is used with the apparatus. As can be seen in FIG. 4, such positioning of the slide member lower portion 90 will leave the entrance port 54 unobstructed so that the enlargement 20 on the downhole member can be inserted into the cavity 48 in the body member 22 or released from the cavity 48. In the capture position of the slide member 80, shown in FIG. 5, the slide member lower portion 90 is positioned at the other end of the axis 58 to overlay thinnest portions of the shoulder 46 and thereby form an obstruction extending across portions of the entrance port 54. The criterion for placement of the groove and socket system on the slide member 80 is that, for a selected position of the pin 114, the slide member 80 will assume one of these two angular positions when the slide member 80 is in the lower axial position.

Thus, should an enlargement 20 be disposed within the cavity 48 in the body member 22 at a time that the slide member 80 is moved from the release position shown in FIG. 4 to the capture position shown in FIG. 5, the enlargement 20 will be shifted along the axis 58 so that portions of the enlargement 20 will overlay the wider portions of the shoulder 46 (and the entrance port restriction member 62 if the member 62 is in the cavity 4B) as shown in phantom line in FIG. 5. Thus, the shoulder 46 or entrance port restriction member 62 will prevent the enlargement 20 from being withdrawn from the cavity 48 in the body member 22. Conversely, if the slide member 80 is moved from the capture position to the release position while an enlargement is within the cavity 48, the enlargement 20 can align with the entrance port 54 and thereby be withdrawn from the cavity 48 in the body member 22. As noted above, the entrance port restriction member 62 permits the effective size of the entrance port 54, such effective size being the distance between the center of the entrance port restriction member 62 and the upper portion 40 of the bore of the sleeve 24 along the diameter 58, to be varied so that the fishing assembly 10 can be used to capture enlargements 20 having a variety of diameters.

The drawings also illustrate one set of positions of the pin 114 and the sockets 110 and 112 which will cause the slide member 80 to be in the capture and release positions shown in FIGS. 4 and 5 when the slide member 80 is in the lower axial position thereof. As shown in FIG. 2, the pin 114 can conveniently be positioned 90° counterclockwise, as viewed from the upper end 36 of the body member 22, from a line that extends upwardly from the center of the groove 60. With such positioning of the pin 114, the capture and release positions can be defined by positioning the upper sockets 110 and 112 in the slide member upper portion 82 such that the upper sockets 110 and 112 are axially aligned with the flats 98 and 100 on the slide member lower portion 90 as has been shown for the land 100 and the upper socket 112 in FIG. 6. Of course, any equivalent set of angular positions for the pin 114 and the sockets 110 and 112 will define the capture and release positions; that is, the pin 114 can be displaced through any angle about the axis of the cavity 48 from the position of the pin shown in FIG. 2 provided that the socket and groove system formed in the slide member upper portion 82 is similarly shifted about the longitudinal axis of the slide member 80 through the same angle without changing the relative positions of the slide member lower portion 90 and the entrance port 54 shown in FIGS. 4 and 5.

From a comparison of FIGS. 2, 3 and 6, it can be seen that the slide member 80 will be disposed in the release position at such times that the pin 114 is positioned in the upper socket 110 and the slide member 80 will be disposed in the capture position when the pin 114 is positioned in the upper socket 112. That is, the hole 135 (FIG. 7) provided in the slide member upper portion 82 to permit mounting of the detachable stop 136 is disposed in the first V-shaped groove leg that opens into the socket which defines the capture position of the slide member 80. The reason for forming the hole 135 adjacent the upper socket that is used to define the capture position rather than the upper socket that defines the release position will be discussed below.

In addition to the body member 22 and the slide member 80, the fishing assembly 10 preferably further comprises a spring 144 shown in FIG. 2, that provides a positive bias of the slide member 80 for the lower position thereof in augmentation of the weight of the slide member 80. The spring 144, which is used when the fishing assembly 10 is lowered on a rod as shown in FIG. 1, permits the user of the fishing assembly 10 to sense transitions of the slide member 80 between the capture and release positions thereof via the force the user exerts downwardly on the rod to cause such transitions in a manner that will be described below.

To provide for the inclusion of the spring 144 in the fishing assembly 10, a bore 146 is formed axially through the slide member upper portion 82 and portions of the bore 146 adjacent the upper end 84 of the slide member 80 are formed on an enlarged diameter to provide an internal shoulder 148 against which the lower end of the spring 144 bears. Similarly, and as shown in FIG. 9, an axially extending bore 150 is formed in lower portions of the end cap 32 to intersect the lower end 52 of the end cap 32. Portions of the bore 150 adjacent the lower end 52 are formed on an enlarged diameter to form a shoulder 152 against which the upper end of the spring 144 will bear. In addition to the bore 150, a transverse bore 154 is formed through portions of the end cap 32 above threaded portion 34 thereof to intersect the upper end of the axial bore 150. The bore 154 and the bore 150 thus provide a relief port from the ambient to the upper end of the cavity 48 that permits well liquids to enter and leave portions of the cavity 48 above the slide member 80 so that well liquids will not interfere with the movement of the slide member 80 within the body member 82. The bore 146 in the slide member upper portion 82 extends to the lower end 86 of the slide member 82 to further the entrance and release of well fluids into and from various portions of the cavity 48.

Operation of FIGS. 1–10

To utilize the fishing assembly 10 to retrieve a downhole member from a well, the operator of the assembly will, if needed, initially select an entrance port restriction member 62 that will provide the body member 22 with an entrance port effective diameter that is suitable for capturing an enlargement 20 on the downhole member that is to be retrieved from a well. Once the entrance port restriction member 62 has been selected, the cap 32 is unscrewed from the sleeve 24 and the spring 144 and slide are removed from the sleeve 24. In particular, the slide member 82 can be rotated in the bore 30 of the sleeve 24 while the lower end 26 of the sleeve 24 is held in a raised position so that the groove 134 is brought into alignment with the pin 114. The slide member 80 can then be dropped out the upper end 28 of the sleeve 24. The entrance port restriction member 62 is then introduced into the upper end 28 of the sleeve 24 and dropped to the lower end 26 thereof. After the entrance port restriction member 62 has been aligned so that the tab 72 thereon is disposed within the groove 60, the screw 78 is introduced into the hole 76 and screwed into the hole in the tab 72 to mount the restriction member 62 within the cavity 48 in the body member 22. The fishing assembly 10 is then reassembled by inserting the slide member 80 into the upper end 28 of the sleeve 24 and rotating the slide member 80 until the cam 114 is aligned with the groove 134. The slide member 80 is then moved relative to the sleeve 24 so that the pin 114 enters the groove 134 while the slide member 80 moves downwardly in the bore 30 of the sleeve 24 to the lower axial position of the slide member, the pin 114 moving through the second leg 132 of the groove 126 to the upper socket 110 during such downward movement of the slide member 80. The spring 144 is then inserted into the bore 146 and the end cap 32 is screwed into the upper end of the sleeve 24. (If the fishing assembly 10 is to be suspended via a wireline rather than a rod, the fishing assembly 10 can be reassembled without the spring 144.) Following the reassembly of the fishing assembly 10, the upper end of the fishing assembly 10 is screwed into a joint on a support rod as shown in FIG. 1 or into a connector on the end of a wireline as discussed above.

Following the attachment of the fishing assembly 10 to a support member 18, the fishing assembly is lowered into the well and the lower end 26 of the body member 22 is brought down on the upper end of the downhole member 12 to be retrieved. The frustoconical lower portion 42 of the bore 30 guides the upper end of the downhole member 12 into the entrance port 54 so that upper portions of the downhole member 12 enter the cavity 48 via the entrance port 54. It will be noted that the positioning of the groove 134 in the slide member upper portion 80 such that the pin 114 is guided into the upper socket 110 when the fishing assembly 10 is assembled as described above, will result in the slide member 80 being in the release position thereof at the time that the fishing assembly 10 is brought down upon the downhole member 12. Thus, the enlargement 20 can enter the cavity 48 via the entrance port 54. Moreover, the length of the slide member lower portion 90 is selected to be sufficient to permit a joint between successive sucker rods to be introduced into the cavity 48 before the upper end of the sucker rod engages the lower end 86 of the slide member upper portion 80. Indeed, the present invention contemplates that the slide member lower portion 90 can be made of sufficient length that an entire sucker rod can be introduced into the trough formed by the slide member lower portion 90 so that broken sucker rods, as well as sucker rods that have become separated from a polish rod or other sucker rods, can be retrieved from a well using the fishing assembly 10. However, the present invention also contemplates the provision of a fishing assembly which is particularly suited to retrieving broken sucker rods as will be discussed below with reference to FIGS. 11–14.

Once the enlarged portion 20 of the downhole member 12 has entered the cavity 48, subsequent downward movement of the fishing assembly 10 will bring the lower end 86 of the slide member upper portion 82 into engagement with the upper end of the downhole member 12. Additional movement of the fishing assembly 10 will then cause the slide member 80 to move toward the upper position thereof so that the pin 114 moves downwardly in the socket 110 to enter the first leg 120 of the V-shaped groove 118. Once the pin 114 enters the leg 120 of the groove 118, the pin 114 will engage the lower edge of the leg 120 to move in the direction within the leg 120 indicated by the arrows 156 and 158 in FIG. 7. That is, the pin 114 will move to the lower socket 122 and, in doing so, cause the slide member 80 to rotate within the body member 22 through approximately one quarter turn in a clockwise direction as viewed from the upper end 36 of the fishing assembly 10. Once the pin 114 reaches the lower socket 122, further downward movement of the fishing assembly 10 is blocked and the fishing assembly 10 is then raised. It will be noted that the socket 122 is positioned to underlie a portion of the second leg 122 of the groove 118 so that, as the fishing assembly 10 is lifted, the pin 114 enters the second leg 124 of the groove 118 to move toward the upper socket 112 as indicated by the arrow 160 in FIG. 7. Thus, for one reciprocation of the slide member 80 in the cavity 48 of the body member 22, in which the slide member moves from the lower axial position to the upper axial position and then back to the lower axial position, the slide member 80 is rotated through one half turn caused by the movement of the pin 114 along the path indicated by the arrows 156 to 160. Accordingly, the slide member 80 will be moved to the capture position that has been illustrated in FIG. 5 to retain the enlargement 20 of the downhole member 12 within the cavity 48 in the body member 22. Thus, the fishing member 10 can thereafter be lifted to retrieve the downhole member 12 from the well.

In some circumstances, the downhole member 12 can become jammed in the well so that upward movement of the fishing assembly 10 will not suffice to remove the downhole member 12 from the well. In this case, the downhole member can often be retrieved by permitting the downhole member 12 to return to its original position in the well, connecting anew to the downhole member, and again drawing the downhole member upwardly in the well. To effect a release of the downhole member, the fishing assembly 10 is again moved downwardly so that the upper end of the downhole member 20 will engage the lower end of the slide member upper portion 80 to cause the slide member 80 to again move toward the upper axial position thereof. During such movement, the pin 114 will move downwardly, relative to the slide member 80, in the first leg 128 of the second V-shaped groove 126, as indicated by the arrows 162, 164 in FIG. 7, to the lower socket 130. The fishing assembly 10 can then be lifted so that the slide member returns to the lower axial position and the pin 114 moves along the second leg 132 of the V-shaped groove 126 to the upper socket 110 as indicated by the arrows 166 and 168 in FIG. 7. That is, the slide member 80 is reciprocated from the lower axial position thereof to the upper axial position thereof and back to the lower axial position thereof and the result of such reciprocation is to turn the slide member through one half turn to return the slide member to the release position thereof. In such position, as can be seen in FIG. 4, the enlargement 20 on the upper end of the downhole member can leave the cavity 48 in the body member 22 via the entrance port 54. Thereafter, the fishing assembly 10 can again be brought down upon the upper end of the downhole member 12 so that the enlargement 20 enters the cavity 48 and the slide member is reciprocated in the cavity 48 to return the slide member 80 to the capture position shown in FIG. 4. The fishing assembly 10 can then again be drawn upwardly to, in many cases, retrive the downhole member from the well.

In some circumstances, jamming of the downhole member 12 cannot be overcome by merely releasing the downhole member 12 and subsequently obtaining a new grip on the member 12. In these cases, the downhole member 12 can often be freed by drawing the downhole member to the position at which the downhole member becomes jammed and then alternately forcefully raising and lowering the downhole member 12. To provide the fishing assembly 10 with this capability, the detachable stop 136 is mounted in the groove 126. That is, the downhole member is released and the fishing assembly 10 is brought to the surface and disassembled so that the stop 136 can be placed in the groove 126 and secured to the slide member 80 via the screw 140. The fishing assembly 10 is then reassembled and attached to the support member 18 for reentry into the well. As in the case in which the fishing assembly is initially assembled as discussed above, the slide member 80 will be in the release position following the reassembly of the fishing assembly 10 with the detachable stop 136 in the V-shaped groove 126.

When the fishing assembly 10 is brought down upon the downhole member 12, the enlargement 20 thereon enters the body member 22 through the entrance port 54 and the fishing assembly 10 is moved downwardly on the downhole member 12 and then upwardly thereon to reciprocate the slide member 80 in the cavity 48 so that the slide member moves to the capture position shown in FIG. 5 and the pin 114 is moved, relative to the slide member, to the socket 112. The fishing tool 10 is then drawn upwardly in the well to lift the downhole member until the downhole member again becomes jammed. Once the downhole member becomes jammed, the fishing assembly 10 is forcefully worked up and down to alternatively raise and lower the downhole member against the obstruction that is causing the jamming. It will be noticed that, because of the presence of the stop 136 in the V-shaped groove 126, the alternate raising and lowering of the fishing assembly 10 will not result in release of the downhole member from the fishing assembly 10. That is, the detachable stop 136 will block entry of the pin into the first leg 128 of the V-shaped groove 126 so that, even though the slide member 80 may be reciprocated in the cavity 48 via the movement of the fishing assembly 10 to work the downhole member up and down in the well, the pin 114 will merely move up and down in the second leg 124 of the V-shaped groove 118 with the result that the pin 114 will always be in the upper socket 112 following a reciprocation of the slide member 80 in the body member 22. Once the downhole member has been freed, the fishing assembly 10 and downhole member 12 can be withdrawn from the well. Should it become desirable to disconnect the fishing assembly 10 from the downhole member while the detachable stop 136 is in place, such detachment can be effected by moving the fishing assembly 10 down on the downhole member 12 to position the pin 114 in the lower socket 122 and then turning the fishing assembly 10 in a counterclockwise direction, as seen from the upper end 36 of the fishing assembly 10, while the fishing assembly 10 is slowly raised on the downhole member so that the pin 114 will enter the first leg 120 of the V-shaped groove 118 to move to the upper socket 110.

DESCRIPTION OF FIGS. 11–14

As has been noted, the slide member lower portion 90 can be provided with substantially any length so that the fishing assembly 10 can be used to retrieve a downhole member from a well without regard to the position of an enlargement on the downhole member that is captured by the slide member lower portion 90 and the shoulder 46. Thus, the fishing assembly 10 can be constructed to retrieve sucker rods that have become separated so that the enlargement 20 is a portion of a joint at the upper end of the sucker rod to be retrieved and the fishing assembly 10 can equally well be constructed to retrieve a sucker rod that has broken, for example, just below a joint, so that the enlargement 20 is disposed a considerable distance below the upper end of portions of the sucker rod remaining in the well. However, the latter construction increases the cost of production of the fishing assembly 10 and, moreover, results in a fishing assembly 10 that is of such a length to become unwieldy. A preferred approach is to construct the fishing assembly 10 with a relatively short slide member 80 sufficient only to capture sucker rod joints and to use a second embodiment of the fishing assembly to retrieve sucker rods that have broken so that the sucker rod to be retrieved terminates at its upper end in a straight section having a substantially constant diameter. A second embodiment of the invention useful under these conditions has been illustrated in FIGS. 11–14.

It will be useful in discussing the embodiment of the fishing assembly shown in FIGS. 11–14 to identify elements and features that are common to both embodiments of the fishing assembly by the same numerals that have been used above in the discussion of the fishing assembly 10 and to append the letter A to those elements of the fishing assembly shown in FIGS. 11–14 which differ qualitatively from the corresponding elements of the fishing assembly 10. Consistent with this approach, the fishing assembly shown in FIGS. 11–14 has been designated by the numeral 10A.

The fishing assembly 10A comprises a body member 22A that differs from the body member 22 in the shaping of lower portions of a tubular sleeve 24A that forms a portion of the body member 22A in the same manner that the sleeve 24 forms a portion of the body member 22. Upper portions of the tubular sleeve 24A are identical to upper portions of the tubular sleeve 24 and the body member 22A comprises an end cap (not shown in FIG. 11) that is identical to the end cap 32 of the body member 22 and is screwed into the tubular sleeve 24A in the same manner that the end cap 32 is screwed into the tubular sleeve 24. Additionally, the body member 22A includes a spring (not shown) that is identical to the spring 144 shown in FIG. 2 and is mounted in the body member 22A in the same manner that the spring 144 is mounted in the body member 22. A pin (not shown) is mounted in the tubular sleeve 24A in the same manner that the pin 114 is mounted in the sleeve 24 as shown in FIG. 2 excepting that the pin in the sleeve 24A is positioned 180° about the sleeve 24A from the position shown in FIG. 2. The purpose for repositioning the pin will be discussed below.

Figure 11:
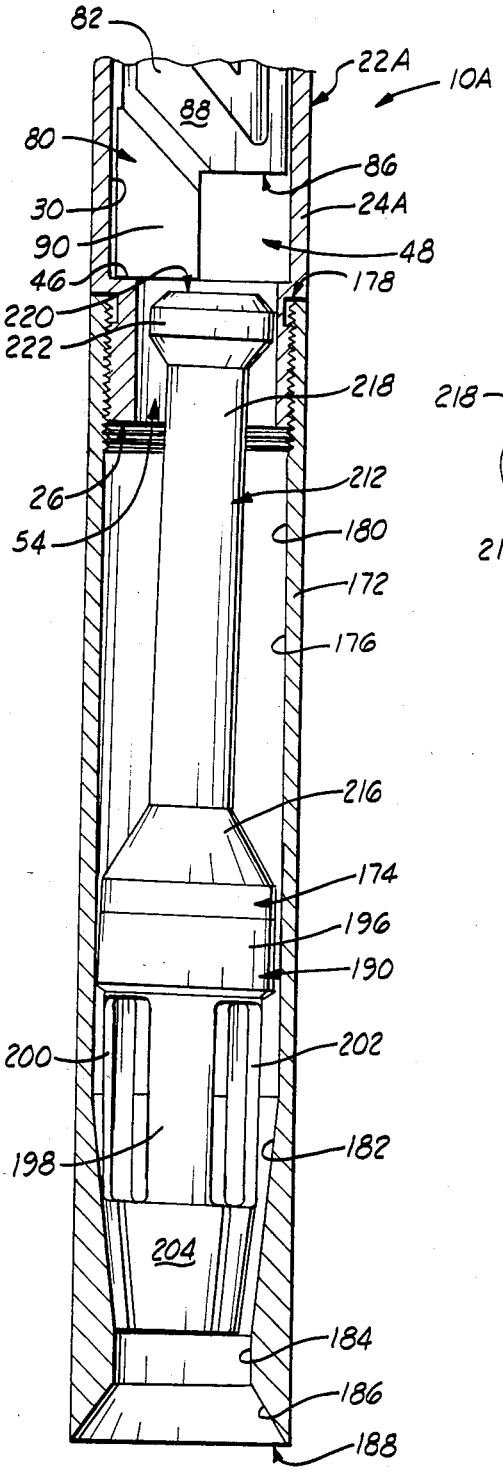
FIG. 11 is a cross section in side elevation and partial cutaway of a second embodiment of the fishing assembly of the present invention.

The fishing assembly 10A also comprises a slide member 80 which is substantially identical to the slide member 80 of the fishing assembly 10. (As shown in FIG. 11, the lower portion of the slide member in the fishing assembly 10A can be made shorter than the slide member lower portion 90 of the slide member 80 of the fishing assembly 10. However, such difference is only one of degree so that it is not necessary to differentiate between the slide members of the fishing assembly 10 and the fishing assembly 10A. The slide member upper portion for the fishing assembly 10A, portions of which are shown in FIG. 11, is identical to the slide member upper portion 82 of the fishing assembly 10 and a socket and groove system is formed in the slide member upper portion of the fishing assembly 10A in the same manner that a socket and groove system is formed in the slide member upper portion of the fishing assembly 10.) Thus, the slide member 80 of the fishing assembly 10A can be moved between upper and lower axial positions and between two diametrically opposed capture and release positions at such times that the slide member of the fishing assembly 24A is in the lower axial position in the same manner that the slide member of the fishing assembly 10 can be moved between such positions.

As shown in FIG. 11, portions of the tubular sleeve 24A adjacent the lower end 26 thereof differ from corresponding portions of the tubular sleeve 24. Thus, the lower portion 42 of the bore 30 of the tubular sleeve 24 is deleted from the tubular sleeve 24A, the entrance port 54 of the body member 22A being formed by an offset bore 44A corresponding to the central portion 44 of the bore 30 of the tubular sleeve 24. Additionally, portions of the outer periphery of the tubular sleeve 24A adjacent the lower end 26 thereof are formed on a reduced diameter and provided with external threads as indicated at 170 in FIG. 11 and no provision is made in the fishing assembly 10A for varying the size of the entrance port 54. That is, entrance port restriction members are not used in the fishing assembly 10A. Rather, the shoulder 46 and the slide member lower portion 90 form the capture assembly in the fishing assembly 10A.

The fishing assembly 10A includes, in addition to the components that make up the fishing assembly 10, a collet support barrel 172 in which a collet 174 is loosely mounted for axial movement in the barrel 172 as shown in FIG. 11. Referring first to the barrel 172, such component is generally tubular in form having a bore 176 that is threaded near the upper end 178 thereof so that the barrel 172 can be screwed onto the lower end 26 of the body member 22A. Extending downwardly from the lower end 26 of the body member 22A, the bore 176 has a cylindrical upper portion 178 and a first intermediate portion 180 whereon is formed an upwardly facing frustoconical surface. Below the portion 180 of the bore 176, the bore 176 can have a cylindrical second intermediate portion 182 and the bore 176 terminates in a downwardly facing frustoconical portion 184 at the lower end 186 of the barrel 172. The frustoconical portion 184 of the bore 176 serves the same purpose as the lower, frustoconical portion 42 of the bore 30 in the fishing assembly 10; that is, to facilitate the entry of a downhole member, such as a broken sucker rod, into lower end portions of the fishing assembly.

In the fishing assembly 10A, the collet 174 is utilized to make a connection to a downhole member rather than the capture assembly formed by the slide member lower portion 90 and the shoulder 46 and the capture assemby is used to control the collet so that the collet will selectively grip or release a substantially constant diameter rod that is axially inserted into the barrel 172. It will be useful, in discussing the fishing assembly 10A to first consider the elements of the collet that enable gripping of a downhole member and the manner in which gripping occurs prior to considering the manner in which the capture assembly controls such gripping.

Figure 13:
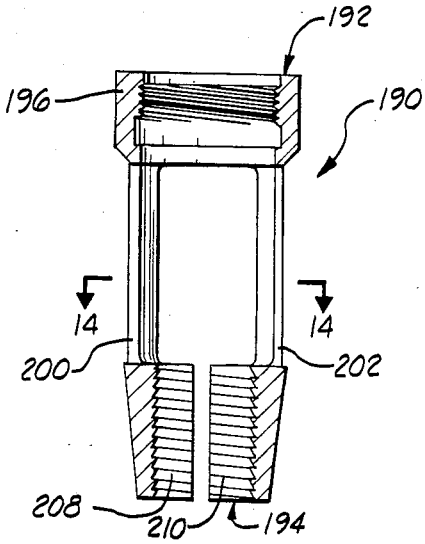
FIG. 13 is a cross section in side elevation of the gripping portion of the collet of the fishing assembly shown in FIG. 11.
Figure 14:
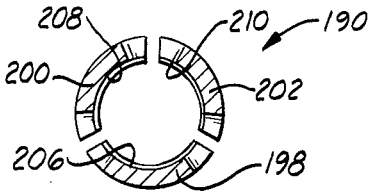
FIG. 14 is a cross section of the collet gripping portion taken along 14—14 of FIG. 13.

As can be seen in FIGS. 11, 13 and 14, the collet 174 is comprised of a collet gripping portion 190 having an upper end 192 that faces the lower end 26 of the body member 22A and a lower end 194 that is disposed in portions of the barrel bore 176 near the lower end 188 of the barrel 172. Adjacent the upper end 192 of the gripping portion 190, the gripping portion 190 comprises an internally threaded ring 196 having an outside diameter that will permit the ring 196 to be loosely held within the upper portion 180 of the barrel bore 176 so that the gripping portion 196 of the collet 174 can slide axially along the bore 176 of the barrel 172. Three fingers 198–200, arranged in a circle as shown in FIG. 14, extend from the ring 196 to the lower end of the gripping portion 190 and a frustoconical surface 204 to mate with the frustoconical first intermediate portion 182 of the barrel bore 176 is formed on the lower end of the collet gripping portion 190 with portions of such surface being formed on each of the three fingers 198–202. Thus, the collet gripping portion 190 can be forced downwardly to engage the frustoconical surface 204 with the frustoconical first intermediate portion 182 of the barrel bore 176 to collapse the fingers 198–202. As shown in FIGS. 13 and 14, internal surfaces 206–210 of portions of the fingers 198–202 respectively adjacent the lower end 194 of the collet gripping portion 190 are curved about the axis of the collet gripping portion to form a bore into which a downhole member to be recovered can be inserted from the lower end 194 of the collet gripping portion 190. The surfaces 202–210 are provided with upwardly facing teeth, as shown for the surfaces 206 and 208 of the fingers 200 and 202 in FIG. 13. Thus, should the fishing assembly 10A be raised while a downhole member having a diameter slightly larger than the bore formed by the internal surfaces 206–210 of the fingers 198–202 is disposed in such bore and while the collet 174 is free to move axially in the barrel 172, gripping of the downhole member would occur. That is, the teeth on the internal surfaces 206–210 of the fingers 198–202 respectively would bite into the downhole member so that the collet 174 would remain stationary on the downhole member while the fishing tool 10A is drawn upwardly. With the collet 174 stationary on the downhole member, the frustoconical surface 204 adjacent the lower end 194 of the collet gripping portion 190 would engage the frustoconical surface formed in the barrel bore 176 by the first intermediate portion 180 of the barrel bore 176 so that the fingers 198–202 would be collapsed about the downhole member to grip the downhole member ever more tightly as the fishing assembly 10A is drawn upwardly. Thus, the collet 174 has an automatic gripping action; that is, so long as the collet 174 is free to move within the barrel bore 176, a downhole member that has been inserted into the lower end 194 of the collet gripping portion 190 will be retained therein to form a connection between the fishing assembly 10A and such downhole member.

Figure 12:
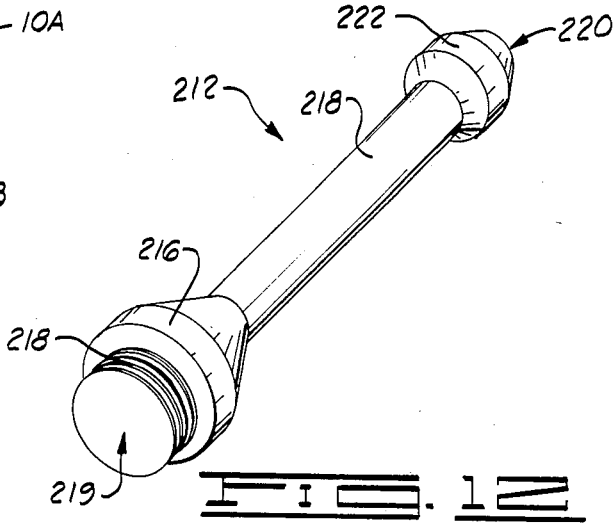
FIG. 12 is an isometric view of the shank portion of the collet of the fishing assembly shown in FIG. 11.

The collet 174 further comprises a shank portion 212 which is connected to the upper end 192 of the collet gripping portion 190 and is constructed to permit prevention of this automatic gripping action of the collet gripping portion 190. Referring to FIG. 12, the shank portion 212 has a lower end portion 216, terminating in a lower end 219 of the shank portion 212, that includes a threaded projection 218 that screws into the interiorly threaded ring 196 at the upper end 192 of the gripping portion 190 to form the collet 174 into a whole. Above the lower end portion 216, the collet shank portion 212 comprises a rod-like central portion 218 that is formed on a diameter substantially smaller than the diameter of the entrance port 54 into the body member 22A. At the top end 220 of the collet shank portion 212, the collet shank portion 212 has an upper end portion 222 that is formed on a larger diameter than the central portion 218 so that the central portion 218 and upper end portion 222 of the shank portion 212 simulate a joint on the upper end of a sucker rod. The lengths of the collet shank portion 212 is selected so that the upper end portion 222 will be disposed withint the entrance port 54 of the body member 22A when the collet is loosely supported in the barrel 172 as shown in FIG. 11. Additionally, the diameter of the upper end portion 222 of the collet shank portion 212 is made only slightly smaller than the diameter of the entrance port 54 so that the upper end portion 222 can be captured in the cavity 48 in the body member 22A in the same manner that a joint on the end of a sucker rod can be captured in the cavity 48 in the body member 22 as has been discussed above.

Operation of FIGS. 11–14

To use the fishing assembly 10A to provide a connection to a substantially uniform diameter downhole member, such as a broken sucker rod, so that the downhole member can be retrieved from a well, it is necessary only that portions of such member be inserted into the bore formed by the interior surfaces 206–210 of the fingers 198–202 of the collet gripping member 190 at a time that the collet 174 is free to move axially toward the lower end of the barrel 172. The automatic gripping action of the gripping portion 190 of the collet 174 that has been described above will then cause a strong connection to be formed between the collet and the downhole member so that the downhole member can be retrieved by drawing the fishing assembly 10A from the well. To achieve this automatic gripping of the downhole member, the upper end portion 222 of the collet shank portion 212 is caused to be captured within the cavity 48 in the body member 22A, via the capture assembly formed by the slide member lower portion 90 and shoulder 46, prior to insertion of the fishing assembly 10A into a well. Such capture of the upper end portion 222 is easily effected, should the capture assembly be in the release position thereof that is the same as the release position shown for the fishing assembly 10, by inserting a rod having diameter substantially smaller than the bore formed by the interior surfaces 206–210 of the fingers 198–202 of the collet gripping portion 190 into the lower end 194 of the collet 174 and pushing the collet 174 upwardly in the barrel bore 176. Since the capture assembly will be in the release position thereof, the enlarged upper end portion 222 of the collet shank portion 218 will enter the cavity 48 in the body member 22A to engage the lower end 86 of the slide member upper portion 82. The slide member 80 can then be axially reciprocated in the cavity 48 formed in the body member 22A so that, when the slide member 80 returns to the axial lower position thereof shown in FIG. 11, the slide member 80 will be in the angular position that defines the capture position for the capture assembly comprised of the slide member lower portion 90 and the shoulder 46. (Such position is an angular position of the slide member 80 that is displaced 180° about the axis of the cavity 48 from the position shown in FIG. 11.) With the slide member 80 in the capture position, the upper end portion 222 of the collet shank portion 218 will be held within the cavity 48 of the body member 22A so that the collet 174 will be held in the position above that shown in FIG. 11 in which the frustoconical surface 204 at the lower end of the collet 174 is spaced above the frustoconical portion 182 of the barrel bore 176. With the collet in such a raised position, the fishing assembly 10A, which will be mounted on a support member in the same manner that the fishing rod 10 is mounted on a support member as shown in FIG. 1, will be lowered into the well.

When the fishing assembly 10A reaches the downhole member to be retrieved, such member enters the downwardly facing frustoconical portion 186 of the barrel bore 176 and and is guided into upper portions of the barrel bore 176 as further lowering of the fishing assembly 10A occurs. Eventually, the upper end of the downhole member reaches the lower end 194 of the collet 174 and begins to enter the bore formed by the interior surfaces 206–210 of the collet fingers 198–202 respectively. The collet gripping portion 190 will have been selected such that the bore formed by the surfaces 206–210 will have a diameter slightly smaller than the diameter of the downhole member so that the collet fingers 198–202 will have to undergo some spreading as the downhole member enters the gripping portion 190 of the collet 174. Thus, the collet 174 will be moved upwardly against the lower end 86 of the slide member upper portion 82 to begin lifting the slide member 80 upwardly from the axial lower position thereof shown in FIG. 11. Such lifting of the slide member 80 is continued until the slide member 80 reaches the upper axial position thereof that is defined in the same manner that such position has been defined in the discussion of the fishing assembly 10. Movement of the fishing assembly 10A downwardly on the downhole member is then continued so that the downhole member will continue upward movement with respect to the collet 174 to enter the bore formed by interior surfaces of the collet fingers 198–202 until the downhole member abuts the lower end 219 of the collet shank portion 212. Thus, the downhole member will be firmly seated within the fingers 198–212 of the gripping portion 190 of the collet 174.

The fishing assembly 10A is then lifted so that the slide member 80 thereof commences to move toward the lower end 26 of the body member 22A in the same manner that the slide member 80 moves toward the lower end 26 of the body member 22 in the fishing assembly 10 when the fishing assembly 10 is lifted. Accordingly, shortly after lifting of the fishing assembly 10A begins, the slide member 80 will have been axially reciprocated in the cavity 48 of the body member 22A so that the capture assembly formed by the slide member lower portion 90 and the shoulder 46 will be moved to the release position as the slide member 80 moves to the lower axial position thereof shown in FIG. 11. The collet 174 will, accordingly, be free to move downwardly in the barrel bore 176 as lifting of the fishing assembly 10A continues to result in the automatic gripping of the downhole member in the manner described above. That is, the downhole member to be retrieved will draw the frustoconical surface 204 at the lower end of the collet 174 against the frustoconical surface 182 at the lower end of the barrel bore 176 to cause the lower end of the collet 174 to become jammed in the lower end of the barrel bore 176 and squeeze the collet fingers 198–202 tightly about the upper end of the downhole member. The downhole member can then be retrieved by withdrawing the fishing assembly 10A from the well.

Should the downhole member become jammed in the well, the downhole member can be released from the fishing assembly 10A in the same manner that a downhole member is released from the fishing assembly 10. That is, all that is required to release the downhole member from the fishing assembly 10A is to force the fishing assembly 10A downwardly and then raise the fishing assembly 10A so that the upper end of the collet 174 enters the cavity 48 of the body member 22A and reciprocates the slide member 80 in the body member 22A so that the slide member 80 will be positioned in the capture position thereof to capture the enlarged upper end portion 222 of the collet shank portion 212. With the upper end portion 222 of the collet shank portion 212 thus captured, the collet 174 will not be free to move downwardly within the barrel bore 176 so that the fingers 198–202 of the collet 174 cannot be jammed into the frustoconical first intermediate portion 182 of the barrel bore 176. Thus, the downhole member will slip against the teeth formed on the interior surfaces 206–210 of the collet fingers 198–202 to leave the collet 174 permitting the fishing assembly 10A to be drawn off the downhole member. Thus, capture and release of a downhole member having uniform diameter near its upper end that the fishing assembly 10 can be effected in the same way that capture and release is effected for a downhole member having an enlargement at its upper end; that is, by pushing downwardly on the fishing assembly and then reaising the fishing assembly to reciprocate the slide member 80 in the cavity 48. Once the downhole member has been released, the fishing assembly 10A can again be brought down upon the downhole member to again cause a reciprocation of the slide member 80 that will release the collet 174 from the body member 22A so that the automatic gripping action of the collet 174 will again cause gripping of uniform diameter portions of the downhole member to be retrieved from the well.

Similarly, the fishing assembly 10A can be used to work a downhole member up and down against an obstruction that is jamming the downhole member in a well without releasing the downhole member from the fishing assembly 10A in the same manner that such working is enabled when the fishing assembly 10 is used to retrieve a downhole member from a well. That is, the detachable stop 136 is mounted within the groove 126 to underlay the socket 112 in the slide member 80 so that, once the pin of the camming system is in the socket 112, it will not be moved to the socket 110 by a reciprocation of the slide member 80 in the cavity 48. Thus, up and down working of the fishing assembly 10A will not result in a change in the angular position of the slide member each time it returns to the lower axial position. Rather, the pin always returns to the socket 112 as the slide member 80 returns to the lower axial position. It will be noted that the position of the pin in the socket 112 for the lower axial position of the slide member 80 is the release position of the slide member 80 in the fishing assembly 10A rather than the capture position of slide member 80 because of the above described change in the position of the pin of the camming assembly from the fishing assembly 10 to the fishing assembly 10A. That is, the pin in the fishing assembly 10A is displaced 180° about the body member 22A from the position shown for the pin 114 in FIG. 2 to cause a reversal in roles of the sockets 110 and 112 in the capture and release of an enlargement in the body member cavity 48. Thus, during up and down working of the fishing assembly 10A with the stop 136 in place, the slide member 80 always returns to the release position thereof as it returns to the lower axial position and the collet is always free to leave the cavity 48. Thus, each time the fishing assembly 10A is drawn upwardly while the stop 136 is in place, the collet 174 can move downwardly in the barrel bore 176 so that the automatic gripping action described above will occur.

It is clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A fishing assembly for use in retrieving a downhole member from a well, comprising:

a body member having a cylindrical cavity formed in central portions thereof about a cavity axis, wherein an entrance port extending to one end of the cavity is formed through one end of the body member whereby portions of a rod can be inserted into said cavity via said entrance port;

a slide member disposed in said cavity for rotation about the cavity axis and reciprocation along the cavity axis from a lower axial position of the slide member adjacent said one end of the cavity and an upper axial position of the slide member adjacent the opposite end of the cavity;

camming means formed partially on the body member and partially on the slide member for relating the angular position of the slide member to the axial position of the slide member and for turning the slide member through one half turn in the body member for each reciprocation of the slide member from the lower axial position thereof, to the upper axial position thereof, and back to the lower axial position thereof, whereby the slide member can be positioned in either of two angular positions at such time that the slide member is in the lower axial position thereof; and capture means formed partially on the body member and partially on the slide member for capturing an enlargement on a rod inserted into said cavity at such times that the slide member is in one of said angular positions defined for the lower axial position of the slide member and for releasing said enlargement at such times that the slide member is in the other of said angular positions defined for the lower axial position of the slide member.

2. The fishing assembly of claim 1 wherein the slide member comprises a cylindrical slide member upper portion having a diameter substantially equal to the diameter of said cavity and extending axially along said cavity axis from a lower end of the slide member upper portion facing said one end of the cavity; and wherein the capture means comprises:

a slide member lower portion projecting from one side of the lower end of the slide member upper portion toward said one end of the cavity; and portions of the body member at one side of said entrance port, the entrance port being formed by a circular bore extending about an axis laterally offset from the cavity axis and parallel to the cavity axis.

3. The fishing assembly of claim 2 wherein the slide member lower portion has the form of a curved, substantially semi-cylindrical trough.

4. The fishing assembly of claim 1 further comprising means for biasing the slide member toward the lower position thereof.

5. The fishing assembly of claim 4 wherein the body member comprises:

a substantially tubular sleeve having a lower end coincident with said one end of the body member; and an end cap mounted atop said sleeve and extending therefrom to the opposite end of the body member, said end cap having means formed thereon for connecting the fishing assembly to a supporting member for lowering the fishing assembly into the well.

6. The fishing assembly of claim 5 wherein the means for biasing the slide member toward the lower end of the cavity is a compression spring disposed between the end cap and the slide member.

7. The fishing assembly of claim 6 wherein a fluid passage bore is formed axially through the slide member upper portion and wherein a relief port to the ambient is formed through the end cap to the cavity in the body member.

8. The fishing assembly of claim 5 wherein a fluid passage bore is formed axially through the slide member upper portion and wherein a relief port to the ambient is formed through the end cap to the cavity in the body member.

9. The fishing assembly of claim 1 wherein the body member comprises:

a substantially tubular sleeve having a lower end coincident with said one end of the body member; and an end cap mounted atop said sleeve and extending therefrom to the opposite end of the body member, said end cap having means formed thereon for connecting the fishing assembly to a supporting member for lowering the fishing assembly into the well.

10. The fishing assembly of claim 9 wherein a fluid passage bore is formed axially through the slide member upper portion and wherein a relief port to the ambient is formed through the end cap to the cavity in the body member.

11. The fishing assembly of claim 1 further comprising an arcuate entrance port restriction member attached to the body member within said cavity adjacent the entrance port to extend across portions of the entrance port.

12. The fishing assembly of claim 1 wherein the camming means comprises:

two diametrically-opposed upper sockets formed in the outer peripheral surface of the slide member upper portion near the upper end of the slide member upper portion;

at least one V-shaped groove formed in the outer peripheral surface of the slide member upper portion and extending between said upper sockets; and a pin mounted in the body member and extending into said cavity to be received in said groove and said upper sockets.

13. The fishing assembly of claim 12 wherein the camming means comprises two V-shaped grooves formed in the outer peripheral surface of the slide member, each V-shaped groove extending between said upper sockets.

14. The fishing assembly of claim 13 wherein said upper sockets are angularly positioned with respect to said V-shaped grooves to axially align said pin with portions of a first leg of one of said grooves when the pin is in one of the upper sockets; and wherein the camming means further comprises a lower socket at the apex of each of said grooves, the lower sockets positioned to axially align said pin with portions of a second leg of one of said grooves when the pin is in one of the lower sockets.

15. The fishing assembly of claim 14 further comprising a detachable stop mounted in the first leg of one of said grooves adjacent one of the upper sockets, said stop having a surface facing said one of the upper sockets and sloping toward the second leg of the other of said grooves.

16. The fishing assembly of claim 1 further comprising:

a tubular collet support barrel mounted on the lower end of the body member and having a bore formed therethrough substantially coaxial to the cavity in the body member, the bore of the collet support barrel having a frusto-conical surface opening toward the lower end of the body member formed in portions thereof displaced from the lower end of the body member; and a collet disposed within the bore of the collet support barrel, the collet comprising:

a collet shank having an upper end adjacent the lower end of the body member and a lower end, wherein the collet shank has an enlarged portion adjacent the upper end thereof; and a collet gripping portion attached to the lower end of the collet shank and having a plurality of fingers extending from the collet shank toward the frusto conical surface formed in the bore of the collet support barrel, wherein a frusto conical surface is formed on the distal ends of said fingers to mate with the frusto-conical surface in the bore of the collet support barrel.

* * * * *